US005179885A

United States Patent [19]

McLeod

[11] Patent Number: 5,179,885

[45] Date of Patent: Jan. 19, 1993

[54] FLYING SHEARS WITH WORKPIECE ALIGNMENT DEVICE

[75] Inventor: Jesse C. McLeod, Louisville, Ky.

[73] Assignee: Raque Food Systems, Inc., Louisville, Ky.

[21] Appl. No.: 646,059

[22] Filed: Jan. 25, 1991

[51] Int. Cl.[5] ..... B26D 1/56

[52] U.S. Cl. ..... 83/315; 83/327; 83/945; 83/946

[58] Field of Search ..... 83/32, 284, 298, 315, 83/327, 945, 946

[56] References Cited

U.S. PATENT DOCUMENTS

| | | | |
|---|---|---|---|
| 2,407,253 | 9/1946 | Conner | 83/327 X |
| 2,857,966 | 10/1958 | Sarka | 83/315 X |
| 3,276,305 | 10/1966 | Burov et al. | 83/315 X |
| 4,253,364 | 3/1981 | Kiefer et al. | 83/945 X |

*Primary Examiner*—Frank T. Yost
*Assistant Examiner*—Raymond D. Woods
*Attorney, Agent, or Firm*—Barnes & Thornburg

[57] ABSTRACT

A cutting assembly for cutting a continuous sheet of material covering containers which are continuously conveyed in spaced apart container carriers in a predetermined direction at a predetermined speed. The cutting assembly includes a support assembly and a mechanism coupled to the support assembly for rotating the support assembly in an orbital path so that the support assembly passes above the container carriers at substantially the predetermined speed and direction during a first portion of the orbital path. The cutting assembly also includes a blade assembly pivotably coupled to the support assembly for cutting the continuous sheet of material as the support assembly moves above the container carriers during the first portion of the orbital path. The cutting assembly further includes an alignment pin for aligning the blade assembly with respect to the container carriers as the blade assembly cuts the sheet of material.

25 Claims, 3 Drawing Sheets

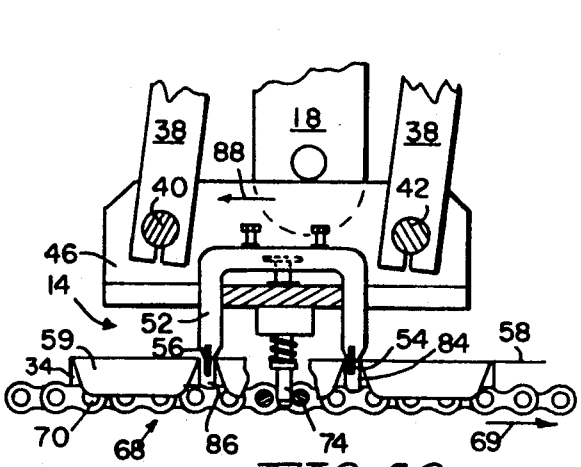
FIG. 4A
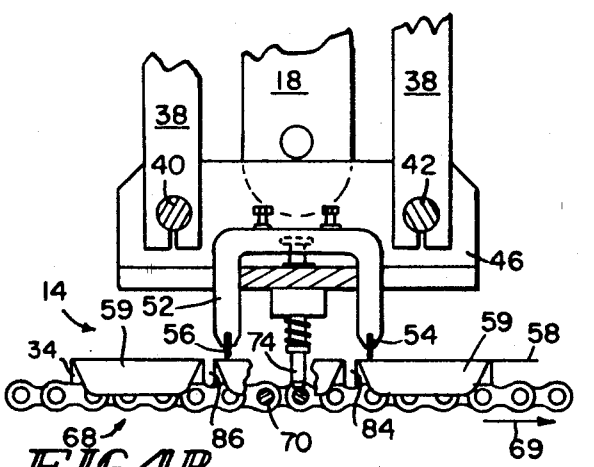
FIG. 4B
FIG. 4C
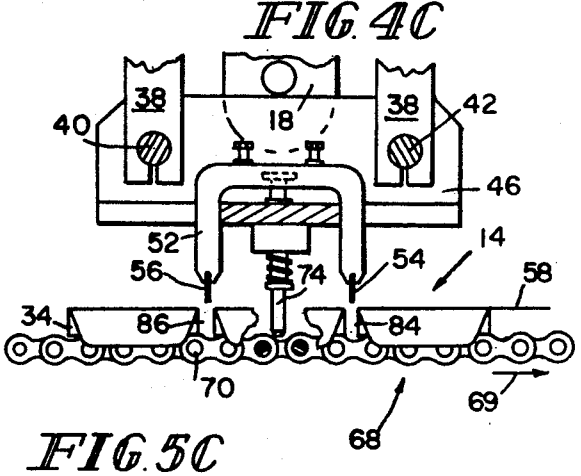
FIG. 5A
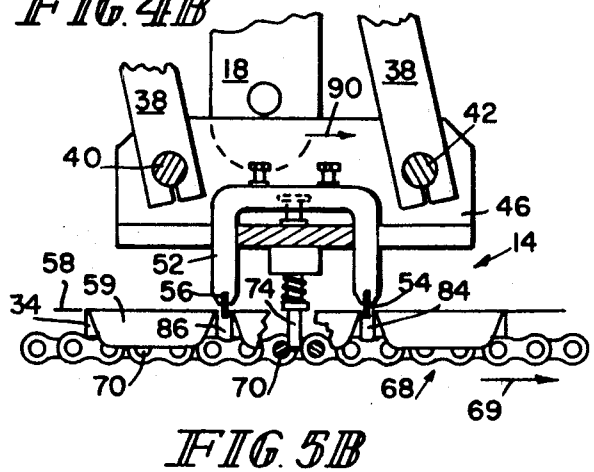
FIG. 5B
FIG. 5C

FLYING SHEARS WITH WORKPIECE ALIGNMENT DEVICE

BACKGROUND AND SUMMARY OF THE INVENTION

This invention relates to an assembly for cutting a continuous sheet of material covering containers which are continuously conveyed in spaced apart container carriers at a predetermined speed. More particularly, the present invention relates to an assembly which automatically aligns a cutting head mechanism with each container carrier and maintains the alignment as the sheet of material is being cut.

Various types of automated systems are known for automatically filling containers moving along a predetermined path with a product such as food or the like. Individual containers which contain one or more servings of food and are sold either refrigerated or frozen are becoming increasingly popular. Such containers are typically processed on an assembly line, with the filling of the containers usually being accomplished by overhead buckets, funnels, or spouts that disperse a metered amount of the product into each individual container.

After the product is placed in the container, a sheet of material is sealed to the top of the containers. Packaging devices often use heat sealing assemblies to seal the sheet of covering material to the containers.

The containers are transported in metal container carriers along the assembly line in a predetermined direction at a predetermined speed. A roller chain is often used to move the container carriers continuously along the assembly line path. The sheet of material covering the containers is typically a continuous sheet. Therefore, after the containers are filled and sealed, the film sheet must be cut so that the containers may be separated from each other.

It is known to provide a film sheet cutting assembly which is rotated in an orbital path so that the cutting assembly moves above each of the container carriers as the container carriers pass below the cutting head assembly. A typical cutting head assembly includes first and second knife blades which pass between adjacent container carriers on opposite sides of a selected container carrier to cut the sheet of material over the container situated in the selected container carrier. A common drive shaft and gears are used to synchronize the movement of the cutting assembly with movement of the carriers. By timing the movement of the cutting assembly with the carriers, the common drive shaft and gears cause first and second knife blades to penetrate gaps between the carriers and cut the sheet of material. Conventional systems rely exclusively on this timing to align the cutting assembly with the container carriers.

Problems have risen in recent years as the characteristics of the covering material have changed. In years past, a thin film sheet was used to seal the containers. The containers were then placed into a visually appealing cardboard box. However, more sophisticated coatings or covering materials have been developed in recent years. These include thicker cardboard sheets or metal films. No outer carton or box is required for these new containers. Therefore, less waste products are produced when the new covering materials are used to seal the containers.

The development of these sophisticated new covering materials has caused problems to arise when the sheet of material is cut by the cutting assembly after the containers have been sealed. The blades of the cutter must dive deeper between the container carriers in order to cut the thicker new materials. This increases the likelihood that the knife blades will be broken during the cutting operation. Particularly, as the knife blades enter and exit the gap between the adjacent carriers the blades can strike the edges of the container carriers and break.

One object of the present invention is to provide a mechanism which maintains alignment of the cutting head assembly with the container carriers during a cutting operation to reduce the likelihood that the knife blades will be broken during the cutting operation.

According to the present invention, a cutting assembly is provided for cutting a continuous sheet of material covering containers which are continuously conveyed in spaced apart container carriers in a predetermined direction at a predetermined speed. The cutting assembly includes a support assembly and means coupled to the support assembly for rotating the support assembly in an orbital path so that the support assembly passes above the container carriers at substantially the predetermined speed and direction during a first portion of the orbital path. The cutting assembly also includes means coupled to the support assembly for cutting the continuous sheet of material as the support assembly moves above the container carriers during the first portion of the orbital path. The cutting assembly further includes means for aligning the cutting means with respect to the container carriers as the cutting means cuts the sheet of material.

In the illustrated embodiment, the support assembly includes first and second spaced apart mounting plates and a cutting head assembly is pivotally coupled to the mounting plates for supporting the cutting means. The aligning means includes a pin member coupled to the cutting head assembly and means for receiving the pin member therein to align the cutting means relative to the container carriers. The receiving means includes a roller chain used to move the container carriers at the predetermined speed and direction. The roller chain has a plurality of rollers for moving the container carriers. The pin members are configured to enter a space between adjacent rollers of the roller chain or indentation in carrier plate to align the cutting means relative to the container carriers.

Also in the illustrated embodiment, the support assembly includes at least two pivot arms coupled between the first and second mounting plates and the cutting head assembly to permit the cutting head assembly and the cutting means to move relative to the support assembly. This advantageously permits the aligning means to compensate and adjust a slight misalignment of the cutting means with respect to the container carriers.

The illustrated embodiment of the present invention also includes a tie bar coupled between the first and second mounting plates and means coupled between the pivot arms and the tie bar for limiting the rate of movement of the cutting head assembly and the cutting means relative to the support assembly. The movement limiting means advantageously prevents a rapid movement of the cutting means relative to the container carriers to reduce the likelihood that the cutting means will be damaged during a cutting operation.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIGS. 4A-4C illustrate a sequential movement of the cutting head assembly relative to the container carriers as the cutting head moves downwardly to engage and cut the sheet of material overlying the containers; and FIGS. 5A-5C illustrate a sequential movement of the cutting head assembly relative to the container carriers as the knife blades exit from between the container carriers after cutting the sheet of material.

DETAILED DESCRIPTION OF THE DRAWINGS

Figure 1:
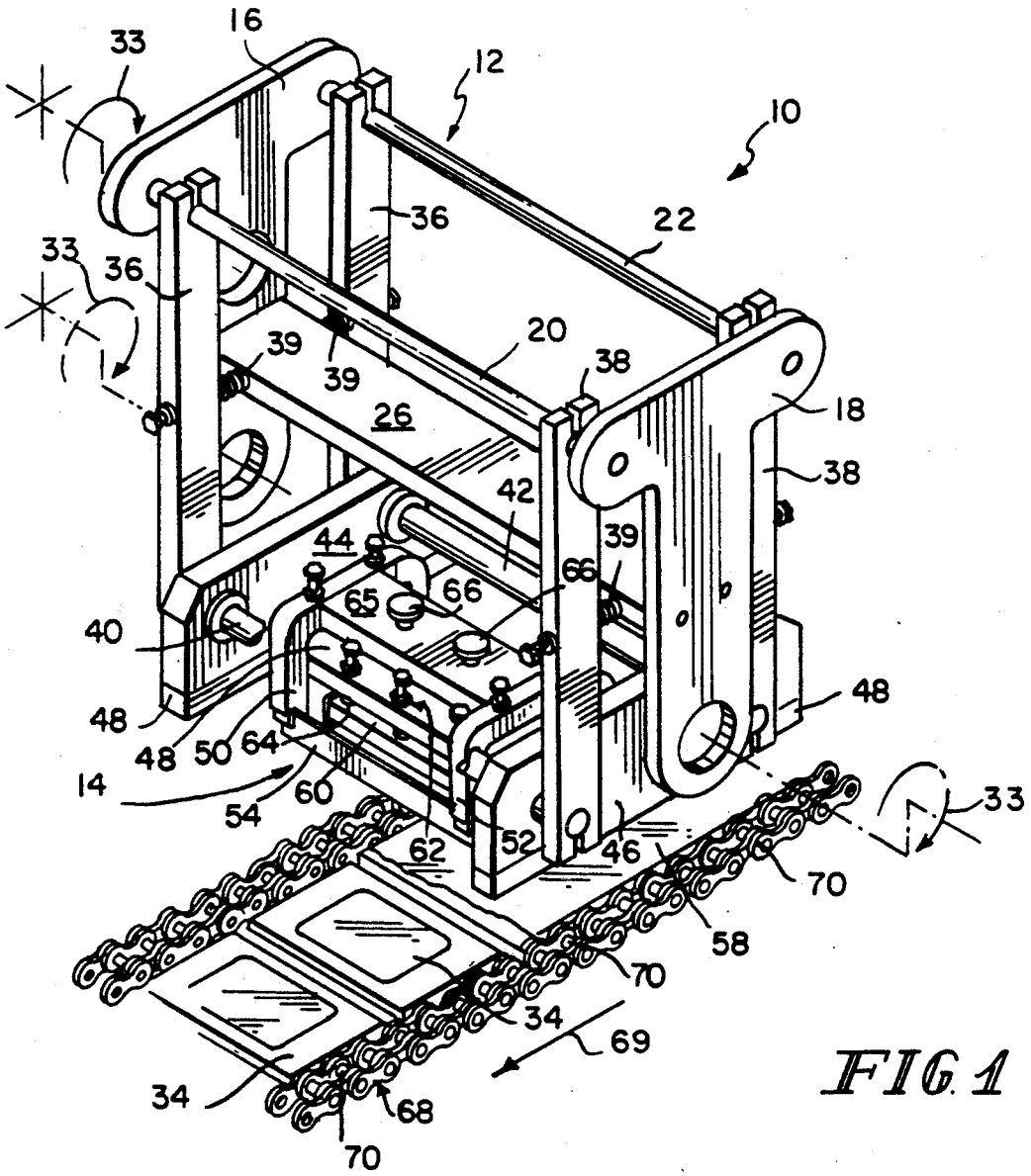
FIG. 1 is a perspective view of a preferred embodiment of the present invention illustrating a cutting assembly for cutting a film sheet sealed to a top opening of containers located in the container carriers.
Figure 2:
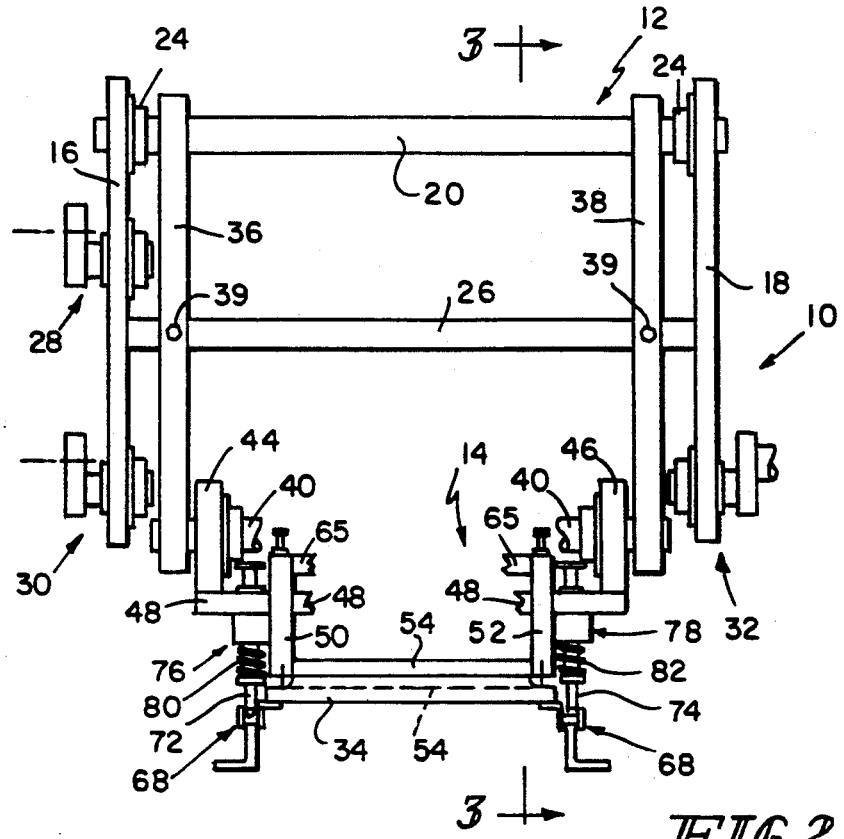
FIG. 2 is a front elevational view of the cutting assembly of FIG. 1 illustrating the position of the locator pin members, Portions of FIG. 2 have been deleted for simplification.
Figure 3:
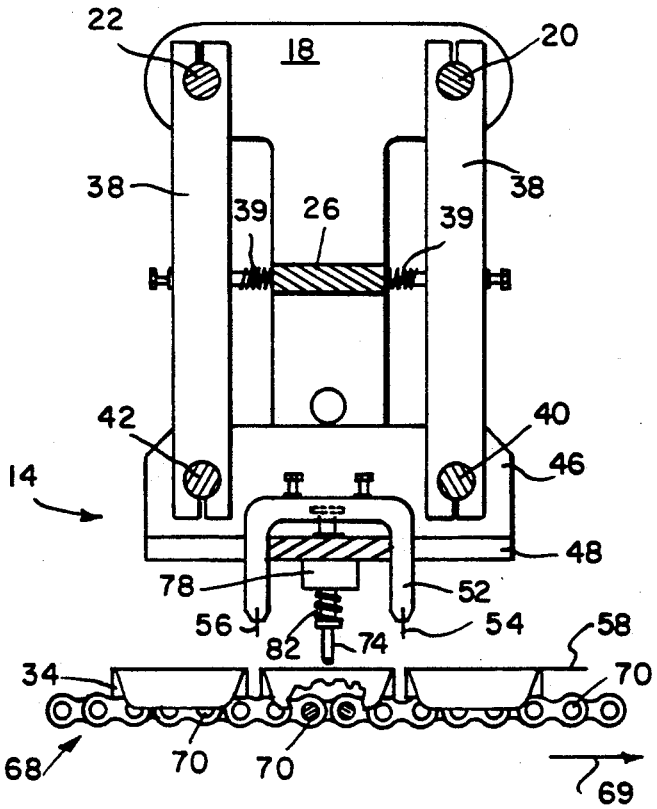
FIG. 3 is a sectional view taken along lines 3—3 of FIG. 2 further illustrating the configuration of the cutting assembly and the container carriers.

Referring now to the drawings, FIGS. 1-3 illustrate a preferred embodiment of the cutting assembly 10 of the present invention. A support assembly 12 is provided for supporting a cutting head assembly 14. Support assembly 12 includes first and second generally T-shaped mounting plates 16 and 18. First and second top pivot shafts 20 and 22 are coupled between first and second mounting plates 16 and 18 as best illustrated in FIG. 1. Pivot shafts 20 and 22 are coupled to apertures formed in mounting plates 16 and 18 by suitable connectors 24 as illustrated in FIG. 2. A tie bar 26 is also coupled between first and second mounting plates 16 and 18.

Eccentric cranks 28 and 30 are coupled to first mounting plate 16 as illustrated in FIGS. 2 and 3. Eccentric crank 32 is coupled to second mounting plate 18. Eccentric cranks 28, 30, and 32 rotate the support assembly 12 in an orbital path illustrated by arrows 33 in FIG. 1. The orbital path carries the support assembly 12 in the direction of movement of container carriers 34 for a first portion of the orbit. The support assembly 12 then moves upwardly away from the container carriers 34, in a direction opposite the container carriers 34, and then back down to overlie the next carrier 34 in the series of continuously moving container carriers 34. Cranks 28, 30, and 32 are driven by chains and sprockets (not shown) coupled to a drive shaft (not shown) which also drives roller chain 68. This synchronizes movement of the cutting assembly 10 with carriers 34.

A first pair of pivot arms 36 are coupled to the first and second pivot shafts 20 and 22 in close proximity to the first mounting plate 16. A second pair of pivot arms 38 are coupled to the first and second pivot shafts 20 and 22 in close proximity to the second mounting plate 18. Bottom pivot shafts 40 and 42 are coupled between the pivot arms 36 and 38. Spring means or dampers 39 are coupled between each of the four pivot arms 36 and 38 and the tie bar 26. Dampers 39 limit the rate that cutting head assembly 14 can move relative to support assembly 12.

A first pivot mount plate 44 is coupled to first and second bottom pivot shafts 40 and 42 in close proximity to the first pair of pivot arms 36. A second pivot mount plate 46 is coupled to bottom pivot shafts 40 and 42 in close proximity to the second pair of pivot arms 38. A horizontal plate 48 is coupled between pivot mounts 44 and 46. Plate 48 provides support for the cutting head assembly 14. Cutting head assembly 14 includes two generally U-shaped knife supports 50 and 52. First and second knife blades 54 and 56 are provided for cutting the sheet of material 58 on opposite sides of each container carrier 34 as the container carrier passes below the cutting assembly 10. Knife blades 54 and 56 extend between knife supports 50 and 52.

The cutting assembly 10 also includes a container knock-out plate 60 coupled to the mounting plate 48 by a plurality of container knock-out bushings 62 and spring members 64. Container knock-out plate 60 engages the containers located in carriers 34 as the knife members 54 and 56 pass between the container carriers 34 and cut the sheet of material 58. Container knock-out plate 60 prevents the containers from being lifted out of the container carriers 34 as the knife members 54 and 56 are retracted from the gaps between the container carriers 34. A cross member 65 is coupled between knife supports 50 and 52. Knob assemblies 66 coupled to cross support member 65 are provided to permit adjustment of the position of the knife blades 54 and 56 relative to horizontal plate 48. A drive chain 68 is used to move the container carriers 34 continuously in a predetermined direction illustrated by arrow 69 in FIGS. 1 and 3 and at a predetermined rate. Drive chain 68 includes a plurality of rollers 70 which are engaged by sprockets (not shown) to move the container carriers 34.

First and second locator pins 72 and 74 are located on opposite ends of cutting head 14 beyond the knife blades 54 and 56 as illustrated in FIGS. 2 and 3. Locator pins 72 and 74 are coupled to the mounting plate 48 by bushings 76 and 78, respectively. Springs 80 and 82 permit locator pins 72 and 74, respectively, to move slightly relative to mounting plate 48. Locator pins 72 and 74 are configured to move between adjacent rollers 70 of drive chain 68 as cutting head assembly 14 moves over container carriers 34. The rollers 70 are always positioned in a predetermined position relative to carriers 34. This aligns the cutting head 14 with the container carriers 34 and directs knife members 54 and 56 into the gaps 84 and 86 between adjacent container carriers 34 as discussed below.

Operation of the present invention is illustrated in FIGS. 4A-4C and 5A-5C. As cutting head assembly 14 is moved in its orbital path by support assembly 12, knife blades 54 and 56 approach the sheet of material 58 overlying containers 59 located in container carriers 34. Knife blades 54 and 56 enter the gaps 84 and 86 between the edges of adjacent container carriers 34 on opposite side of a selected container carrier 34. The sheet of material 58 can be a thick cardboard sheet or a metal sheet. Therefore, it is necessary for the knife blades 54 and 56 to dive deeply between the container carriers 34 in order to completely cut the sheet of material 58. Upon entry into or exit from the gaps 84 and 86, the knife blades 54 and 56 can strike the edges of container carriers 34 and break. Therefore, locator pins 72 and 74 are provided to reduce the likelihood that the knife blades 54 and 56 will strike the edges of container carriers 34.

FIGS. 4A–4C illustrate the sequence of movement of the cutting head assembly 14 as the knife blades 54 and 56 approach and cut the sheet of material 58. In FIG. 4A, cutting head assembly 14 is approaching the series of continuously moving container carriers 34. As the cutting head assembly 14 gets closer to the container carriers 34 as illustrated by FIG. 4B, locator pin 74 strikes one of the rollers 70 of drive chain 68. As illustrated in FIG. 4B, the knife blades 54 and 56 are directed to enter gaps 84 and 86, respectively, at locations very close to the edges of container carriers 34. However, as locator pin 74 is forced between two adjacent rollers 70 of drive chain 68, cutting head assembly 14 is pulled back in the direction of arrow 88 in FIG. 4C so that locator pin 74 drops between adjacent rollers 70. This guides knife blades 54 and 56 into the gaps 84 and 86, respectively, between adjacent container carriers 34 without striking the edges of the container carriers 34. FIG. 4C illustrates that pivot arms 38 have moved relative to their initial position to permit cutting head assembly 14 to move relative to mounting plates 16 and 18. Movement is exaggerated for illustrative purposes. Cooperation of the locator pin 74 and the pivotal cutting head assembly 14 provide aligning means to reduce the likelihood that the knife blades 54 and 56 will be broken upon entry into the gaps 84 and 86 between container carriers 34.

FIGS. 5A–5C illustrate the sequence of movement of cutting head assembly 14 as the knife blades 54 and 56 are removed from the sheet of material 58. As container carriers 34 and head assembly 14 continue to move in the direction of arrow 69, knife head assembly 14 begins to move upwardly away from the container carriers 34. In FIG. 5A, head assembly 14 begins to move upwardly with respect to the container carriers 34. Because the carriers continuously move in the direction of arrow 69, the edges of the container carriers 34 could possibly strike the knife blades 54 and 56 as the cutting assembly 14 begins to move the knife blades 54 and 56 out from the gaps 84 and 86 between adjacent container carriers 34. However, locator pin 74 again engages a roller 70 of drive chain 68 which causes the cutting head assembly 14 and pivot arms 38 to move in the direction of arrow 90 in FIG. 5B. This movement of cutting head assembly 14 permits the knife blades 54 and 56 to clear the edges of the container carriers 34 without striking the edges of container carriers 34. After knife blades 54 and 56 have cleared the container carriers 34, locator pin 74 is released from rollers 70 and the cutting head assembly 14 moves back to its normal position as illustrated in FIG. 5C due to gravity. The spring means or dampers 39 may also assist in moving cutting head assembly 14 back to its normal position illustrated in FIG. 5C after locator pin 74 is released from rollers 70. Rotatable support assembly 12 then rotates to move the cutting head assembly 14 in an orbital path to overlie the next container 59 in the series of continuously moving container carriers 34 so that sheet of material 58 is cut over the next container 59 in the same manner as described above.

Although the invention has been described in detail with reference to a certain preferred embodiment, variations and modifications exist within the scope and spirit of the invention as described and defined in the following claims.

What is claimed is:

1. A cutting assembly for cutting a continuous sheet of material covering containers which are continuously conveyed in a predetermined direction and at a predetermined speed in spaced apart container carriers, the cutting assembly comprising a support assembly, means coupled to the support assembly for rotating the support assembly in an orbital path so that the support assembly passes above the container carriers at substantially the predetermined speed and direction during a first portion of the orbital path, means pivotably coupled to the support assembly for cutting the continuous sheet of material as the support assembly moves above the container carriers during the first portion of the orbital path, and means for aligning the cutting means with respect to the container carriers as the cutting means cuts the continuous sheet of material.

2. The assembly of claim 1, wherein the support assembly includes first and second spaced apart mounting plates and a cutting head assembly pivotably coupled to the mounting plates for supporting the cutting means, and the aligning means includes a pin member coupled to the cutting head assembly and means on the container carriers for receiving the pin member to align the cutting means relative to the container carriers.

3. The assembly of claim 2, wherein the receiving means includes a roller chain having a plurality of rollers for moving the container carriers, the pin member being configured to enter a space defined between adjacent rollers of the roller chain to align the cutting means relative to the container carriers.

4. The assembly of claim 2, wherein the support assembly further includes at least two pivot arms coupled between the mounting plates and the cutting head assembly to permit the cutting head assembly and the cutting means to move relative to the support assembly.

5. The assembly of claim 4, further comprising a tie bar coupled between the first and second mounting plates and means coupled between the pivot arms and the tie bar for limiting the rate of movement of the cutting head assembly and the cutting means relative to the support assembly.

6. A cutting assembly for cutting a continuous sheet of material covering containers located in a series of continuously moving container carriers conveyed in a predetermined direction at a predetermined speed by a roller chain, each carrier being spaced apart from adjacent carriers by a predetermined distance defining a gap between adjacent carriers, the cutting assembly comprising a support assembly including first and second spaced apart mounting plates and at least two arm members pivotably coupled to the first and second mounting plates, means coupled to the support assembly for rotating the support assembly in an orbital path so that the support assembly passes above the container carriers at substantially the predetermined speed and direction during a first portion of the orbital path, a cutting head assembly coupled to the at least two arm members to suspend the cutting head assembly above the container carriers, first and second knife blades coupled to the cutting head assembly, the knife blades being configured to enter the gaps between adjacent container carriers on opposite sides of a selected carrier to cut the continuous sheet of material during the first portion of the orbital path, and a pin member coupled to the cutting head assembly for aligning the cutting head assembly with respect to the container carriers as the first and second knife blades cut the continuous sheet of material.

7. The assembly of claim 6, wherein the pin member is configured to engage one of two adjacent rollers upon entry into and exit from a space between the two adjacent rollers to move the cutting head assembly relative to the support assembly to align the first and second knife blades with the gaps on opposite sides of the selected carrier.

8. The assembly of claim 6, further comprising means coupled to the at least two arm members for limiting the rate of movement of the cutting head assembly relative to the support assembly.

9. The assembly of claim 6, further comprising means for adjusting the position of the first and second knife blades relative to the cutting head assembly.

10. The assembly of claim 6, further comprising means for engaging the containers as the first and second knife blades cut the sheet of material to prevent the containers from being removed from the container carriers.

11. The assembly of claim 10, wherein the engaging means includes a plate member coupled to the cutting head assembly by a plurality of spring means so that the plate member is movable relative to the cutting head assembly.

12. The assembly of claim 6, wherein the pin member is coupled to the cutting head assembly with a bushing, the pin member being spring biased to a predetermined position to permit limited movement of the pin member relative to the cutting head assembly.

13. A cutting assembly for cutting a continuous sheet of material covering containers located in a series of continuously moving spaced apart container carriers conveyed in a predetermined direction at a predetermined speed, the cutting assembly comprising a support assembly, means coupled to the support assembly for rotating the support assembly in an orbital path so that the support assembly passes above the container carriers at substantially the predetermined speed and direction during a first portion of the orbital path, means for cutting the continuous sheet of material as the support assembly moves above the container carriers during the first portion of the orbital path, means for pivotably coupling the cutting means to the support assembly to permit limited movement of the cutting means relative to the support assembly as the cutting means cuts the continuous sheet of material, and means for aligning the cutting means with respect to the container carriers as the cutting means cuts the continuous sheet of material.

14. The assembly of claim 13, wherein the support assembly includes first and second spaced apart mounting plates and the cutting means includes a cutting head assembly pivotally coupled to the mounting plates and at least one knife blade coupled to the cutting head assembly for cutting the continuous sheet of material.

15. The assembly of claim 14, wherein the means for coupling the cutting means to the support assembly includes at least two pivot arms coupled between the mounting plates and the cutting head assembly to permit the cutting head assembly to move relative to the support assembly.

16. The assembly of claim 13, wherein the aligning means includes a pin member coupled to the cutting means and means on the container carriers for receiving the pin member to align the cutting means relative to the container carriers.

17. The assembly of claim 13, further comprising means coupled between the cutting means and the support assembly for limiting the rate of movement of the cutting means relative to the support assembly.

18. A cutting assembly for cutting a continuous sheet of material covering containers which are continuously conveyed in a predetermined direction and at a determined speed in spaced apart container carriers, the cutting assembly comprising a support assembly, means coupled to the support assembly for rotating the support assembly in an orbital path so that the support assembly passes above the container carriers at substantially the predetermined speed and direction during a first portion of the orbital path, means cutting a continuous sheet of materials as the support assembly moves above the container carriers during the first portion of the orbital path, means for pivotably coupling the cutting means to the support assembly to permit limited movement of the cutting means relative to the support assembly, means coupled to the support assembly for limiting the rate of movement of the cutting means relative to the support assembly, and means for aligning the cutting means with respect to the container carriers as the cutting means cuts the continuous sheet of material.

19. The assembly of claim 18, wherein the means for coupling the cutting means to the support assembly includes at least two arm members coupled between the support assembly and the cutting means, and the means for limiting the rate of movement of the cutting means relative to the support assembly includes a damper coupled between the support assembly and the at least two arm members.

20. The assembly of claim 18, wherein the aligning means includes a pin member coupled to the cutting means and means on the container carriers for receiving the pin member to align the cutting means relative to the container carriers.

21. The assembly of claim 20, wherein the receiving means includes a roller chain having a plurality of rollers for moving the container carriers, the pin member being configured to enter a space defined between adjacent rollers of the roller chain to align the cutting means relative to the container carriers.

22. An assembly for processing a material which is continuously conveyed in a predetermined direction and at a predetermined speed, the assembly comprising a support assembly, means coupled to the support assembly for moving the support assembly in a predetermined path so that the support assembly passes above the material at substantially the predetermined speed and direction during a first portion of the path, a tool for working on the material as the support assembly moves above the material during the first portion of the path, means for pivotably coupling the tool to the support assembly to permit limited movement of the tool relative to the support assembly, and means for aligning the tool with respect to the material as the support assembly moves over the material.

23. The assembly of claim 22, wherein the support assembly includes first and second spaced apart mounting plates and the tool is pivotably coupled to the mounting plates, and the aligning means includes a pin member coupled to the tool and means on the container carriers for receiving the pin member to align the tool relative to the material.

24. The assembly of claim 23, wherein the receiving means includes a roller chain having a plurality of rollers for moving the material in the predetermined direction and at the predetermined speed, the pin member being configured to enter a space defined between adjacent rollers of the roller chain to align the tool relative to the material.

25. The assembly of claim 23, wherein the support assembly further includes at least two pivot arms coupled between the mounting plates and the tool to permit the tool to move relative to the support assembly.

* * * * *